US006220910B1

(12) United States Patent
Richey

(10) Patent No.: US 6,220,910 B1
(45) Date of Patent: Apr. 24, 2001

(54) EXPANDABLE SAFETY FLAG FOR FLOTATION DEVICE

(76) Inventor: Tamie L. Richey, 7728 CR 4095, Kaufman, TX (US) 75142

( * ) Notice: Subject to any disclaimer, the term of this patent is extended or adjusted under 35 U.S.C. 154(b) by 0 days.

(21) Appl. No.: 09/549,007

(22) Filed: Apr. 14, 2000

(51) Int. Cl.[7] ..... B63C 9/08
(52) U.S. Cl. ..... 441/89
(58) Field of Search ..... 441/89, 11, 88, 441/80; 116/173

(56) References Cited

U.S. PATENT DOCUMENTS

| | | | | |
|---|---|---|---|---|
| 3,122,736 | | 2/1964 | Weber | 340/366 |
| 3,877,096 | | 4/1975 | Scesney | 9/14 |
| 4,035,856 | | 7/1977 | Oberg | 9/313 |
| 4,416,212 | | 11/1983 | Howard | 116/210 |
| 4,475,476 | | 10/1984 | Howard | 116/210 |
| 4,598,661 | | 7/1986 | Roe | 116/209 |
| 4,752,264 | | 6/1988 | Melendez et al. | 441/89 |
| 5,329,873 | * | 7/1994 | Tiballi | 116/173 |
| 5,343,825 | * | 9/1994 | Gazecimeon et al. | 116/173 |
| 5,651,711 | | 7/1997 | Samano | 441/89 |
| 5,839,931 | * | 11/1998 | Shieh | 441/6 |
| 5,893,786 | | 4/1999 | Stevens | 441/89 |
| 6,033,275 | * | 3/2000 | Ely | 441/89 |

* cited by examiner

*Primary Examiner*—Ed Swinehart
(74) *Attorney, Agent, or Firm*—Smith, Danamraj & Youst, P.C.

(57) ABSTRACT

An expandable safety flag stowed in a pouch attached to a flotation vest. The pouch includes an opening leading to an interior of the pouch. When not in use, the safety flag is stowed within the interior of pouch. When desired, the safety flag is removed from the pouch and expanded to a larger size. The user can then wave the flag to attract the attention of others.

9 Claims, 3 Drawing Sheets

EXPANDABLE SAFETY FLAG FOR FLOTATION DEVICE

BACKGROUND OF THE INVENTION

1. Technical Field of the Invention

This invention relates to safety flags, and more particularly, to an expandable safety flag stored on a flotation device.

2. Description of Related Art

Water and boating activities are becoming increasingly popular. Boats and personal water craft, such as jet skis, continue to proliferate, causing crowding of many lakes and coastal waters. With the increased traffic on these waters, the dangers for people swimming in the water has increased. For example, skiers may fall in the water, either at the end of their skiing run or accidentally. The boats towing the skiers must swing the boats around in a relatively wide turn in order to retrieve the skier. During the repositioning of the towing boat, the skier is left alone in the water, presenting hazards to the skier. Other boats, unaware of the person in the water, may drive their boat over or dangerously close to the person. Additionally, the towing boat may lose sight of the person during the turn, causing difficulties in finding and retrieving the person.

The same hazards seen with fallen skiers are also encountered by other individuals, such as swimmers or passengers of a boat who fall into the water. The individuals are partially obstructed from view by the water. Since the individuals are not easily seen, they may also be run over by water craft. In addition, water craft operators whose boats are inoperative have difficulty attracting the attention of others and signaling for assistance.

Although there are no known prior art teachings of a solution to the aforementioned deficiency and shortcoming such as that disclosed herein, prior art references that discuss subject matter that bears some relation to matters discussed herein are U.S. Pat. No. 4,598,661 to Roe (Roe), U.S. Pat. No. 5,651,711 to Samano (Samano), and U.S. Pat. No. 5,893,786 to Stevens (Stevens).

Roe discloses a signal device for attachment to a flotation vest. The signal device includes a telescoping flat member and a support member to support the telescoping flag member in an upright manner. The support member is attached to the flotation vest. Although Roe discloses a safety flag to mark the location of the wearer of the flotation vest, Roe does not teach or suggest an expandable flag which can be removed from the flotation vest. Roe suffers from the disadvantage of fixing the flag to the vest, which does not allow the wearer to wave the flag. Since the flag remains fixed to the wearers vest, the flag cannot be used to its maximum advantage, such as by waving the flag to attract the attention of others. Additionally, a stationary flag could make a swimmer appear as a small buoy, and boaters may ignore it or still pass dangerously close.

Samano discloses a flotation vest which has a flexible mast attached to a portion of the vest. A flag is attached to the uppermost portion of the mast. The mast is fastened at one end to the vest, and when not in use, is bent over a wear's shoulder and attached to the shoulder of the wearer. When utilizing the flag, the wearer detaches one end from his shoulder, releasing the flag and allowing the flag to extend upwardly. Samano does not teach or suggest removing the flag from the flotation vest. Therefore, Samano requires that the flag stay fixed to the vest, again preventing the movement of the flag and decreasing the effectiveness of the flag.

Stevens discloses an automatic, telescoping signal device attached to a flotation vest. The device includes a telescoping spotting pole mounted to the back of the flotation vest. The spotting pole slides freely from the main housing of the device. At the top of the spotting pole is a flag. The spotting pole automatically extends from the main housing when the wearer is submerged in the water. Stevens does not teach or suggest an expandable safety flag which is removable from the flotation vest. Stevens suffers from the disadvantage of being fixed to the back of the wearer, which is restricts the movement of the flag by the wearer.

Review of each of the foregoing references reveals no disclosure or suggestion of a apparatus as that described and claimed herein. Thus, it would be a distinct advantage to have an apparatus which is easily stored within the flotation device and can be removed to signal boaters of the location of the wearer of the flotation device. It is an object of the present invention to provide such an apparatus.

SUMMARY OF THE INVENTION

In one aspect, the present invention is an expandable signaling system for use by a person located in the water. The system includes a flotation device providing flotation means to the person and a pouch attached to the flotation device. The pouch has an opening leading to an interior of the pouch. In addition, the system includes a safety flag having expanding means allowing the safety flag to be enlarged when deployed. The safety flag is stowed within the interior of the pouch and removed from the pouch and expanded to a larger size to allow the person to signal the location of the person within the water.

In another aspect, the present invention is a signaling device for use on a flotation device worn by a person. The device includes a pouch having an opening attached to the flotation device and a safety flag having expanding means allowing the safety flag to be enlarged when removed from an interior of the pouch. The safety flag is stowed within the interior of the pouch and removed from the pouch and expanded to a larger size to allow the person to signal the location of the person.

In still another aspect, the present invention is an expandable signaling system for use by a person located in the water. The system includes an elastomeric band attached to the person and a pouch attached to the band. The pouch has an opening leading to an interior of the pouch. In addition, the system includes a safety flag having expanding means allowing the safety flag to be enlarged when deployed. The safety flag is stowed within the interior of the pouch and removed from the pouch and expanded to a larger size to allow the person to signal the location of the person.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

An expandable safety flag stored within a flotation device is disclosed.

Figure 1:
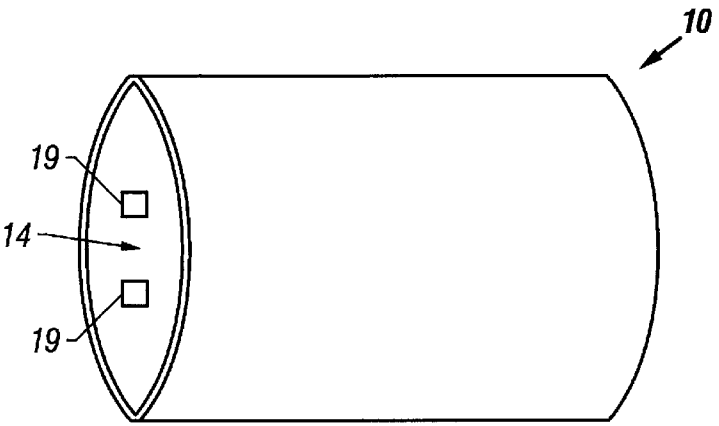
FIG. 1 is a front view of a pouch for stowing the safety flag of the present invention.

FIG. 1 is a front view of a pouch for stowing a safety flag 12 of the present invention. The pouch is a pocket for holding the expandable safety flag 12 (FIG. 3) constructed of a durable material. In the preferred embodiment of the present invention, the pouch is two pieces of a waterproof ballistic nylon material sewn together, thus providing a pocket to place the safety flag within.

The pouch 10 may optionally include a closeable pouch opening 14 located on one side of the pouch from which the safety flag may enter and exit an interior of the pouch. The pouch opening may be closed when it is desired to secure the safety flag in the pocket. The pouch opening may be securely closed by the use of any means providing an easy access for a user to reach the interior of the pouch, such as pins, adhesive strips, snaps or zippers. In the preferred embodiment of the present invention, the pouch opening uses hook and pile (commonly known as VELCRO®) strips 19 to close the pouch opening. In alternate embodiments of the present invention, the pouch opening may be located anywhere on the pouch, such as the side, bottom or front portion of the pouch. Additionally, a closeable flap (not shown) may be used to secure the pouch in a closed position.

Figure 2:
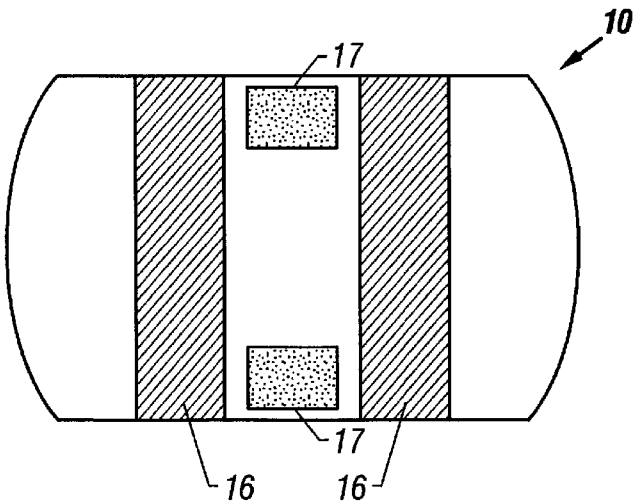
FIG. 2 is a rear view of the pouch of FIG. 1.

FIG. 2 is a rear view of the pouch 10 of FIG. 1. In the preferred embodiment, the pouch includes one or more loops 16 attached to a rear surface of the pouch. The loops are pieces of material used to fasten the pouch to a flotation vest. The loops are attached on each end to the rear surface of the pouch. Between each end of the loop is an opening between the rear surface of the pouch and the loop. In an alternate embodiment, the present invention may include hook or pile strips 17 for affixing the pouch to a flotation device having corresponding hook or pile strips.

Figure 3:
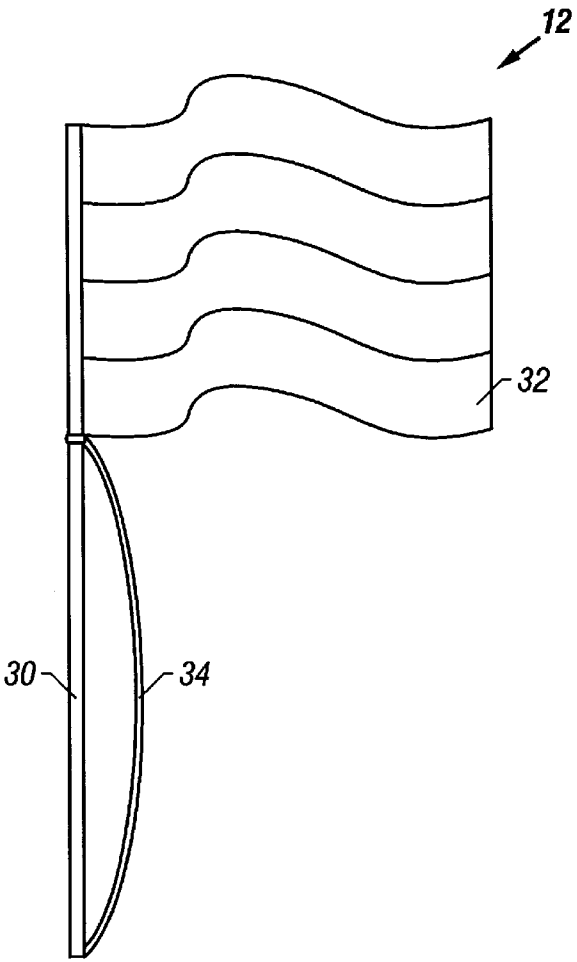
FIG. 3 is a front view of a safety flag illustrating a spring-loaded mast.
Figure 7:
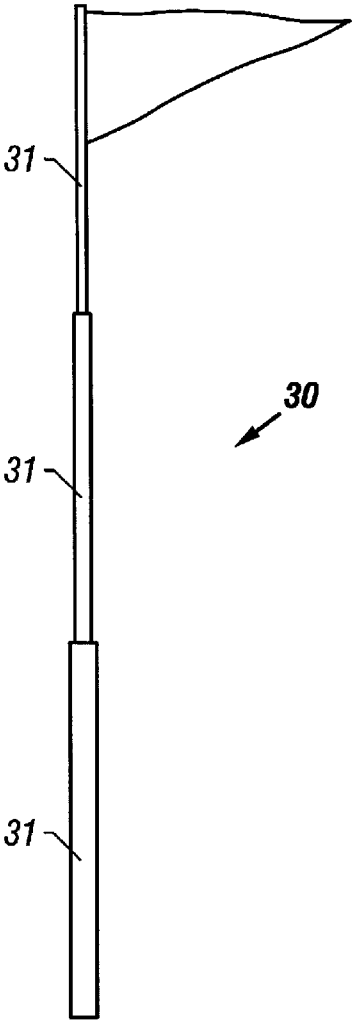
FIG. 7 is a front view of the safety flag illustrating telescopic sections in an alternate embodiment of the present invention.
Figure 6:
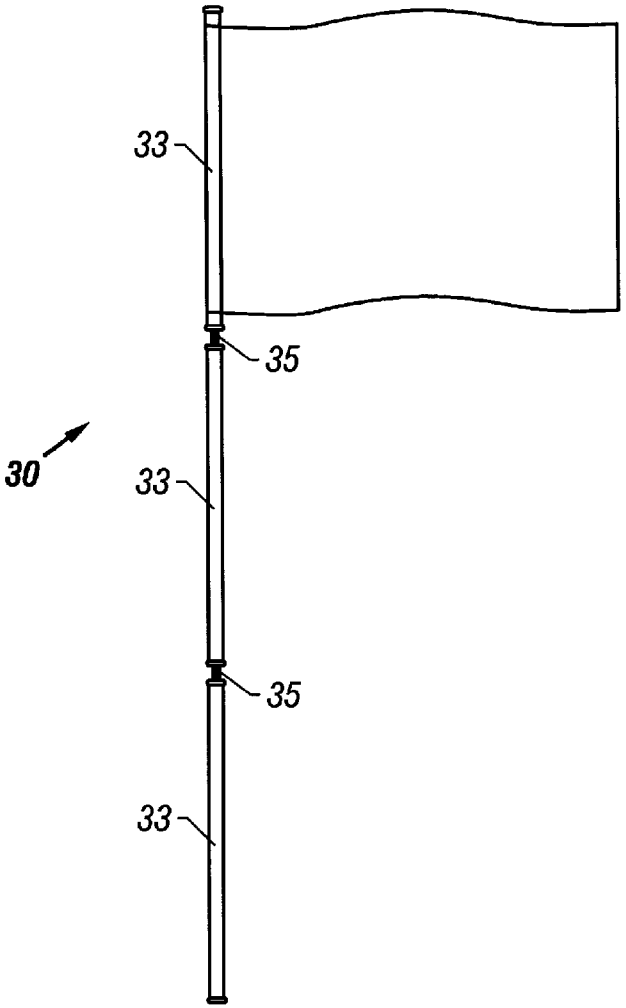
FIG. 6 is a front view of the safety flag illustrating detachable sections in an alternate embodiment of the present invention.

FIG. 3 is a front view of the safety flag 12 illustrating a spring-loaded mast 30. The safety flag includes the mast 30, a banner 32, and an optional handle 34. The mast is constructed of a durable material. In the preferred embodiment of the present invention, the mast is constructed of a flexible, elastomeric material allowing the mast to be bent in half (or multiple parts) when stowed within the pouch 10 and to spring open to its full length when removed. The mast may include a hinge to bend the mast into a smaller length. In an alternate embodiment of the present invention, the mast may be telescopically extended to increase the length of the mast. When the safety flag is stored in the pouch, the mast should be decreased in length. FIG. 7 illustrates sections 31, which telescopically extend to provide a greater length of the mast 30. In another alternate embodiment, the staff may be constructed of several hollow tubing sections interconnected by a stretchable "bungee" cord located within the center of each tubing section. When extended, the tubing sections are connected together. When the safety flag is stored, the sections are disassembled. The sections are held attached to each other by the stretchable cord. In FIG. 6, the mast 30 is divided into sections 33 and attached by stretchable cord 35. The banner is preferably constructed of a flexible brightly colored material. The safety flag may also include the optional handle 34 to allow easy handling of the safety flag.

The handle allows easy access to the safety flag when removing the safety flag from the pouch 10. Addition, the handle provides a place for an individual to easily hold the safety flag when in use. The handle may be constructed of any material providing a solid, durable surface for holding and grasping the safety flag. The handle may alternatively be a loop of flexible material. Additionally, the handle may be constructed of a material which floats on water, such as float-able foam.

Figure 4:
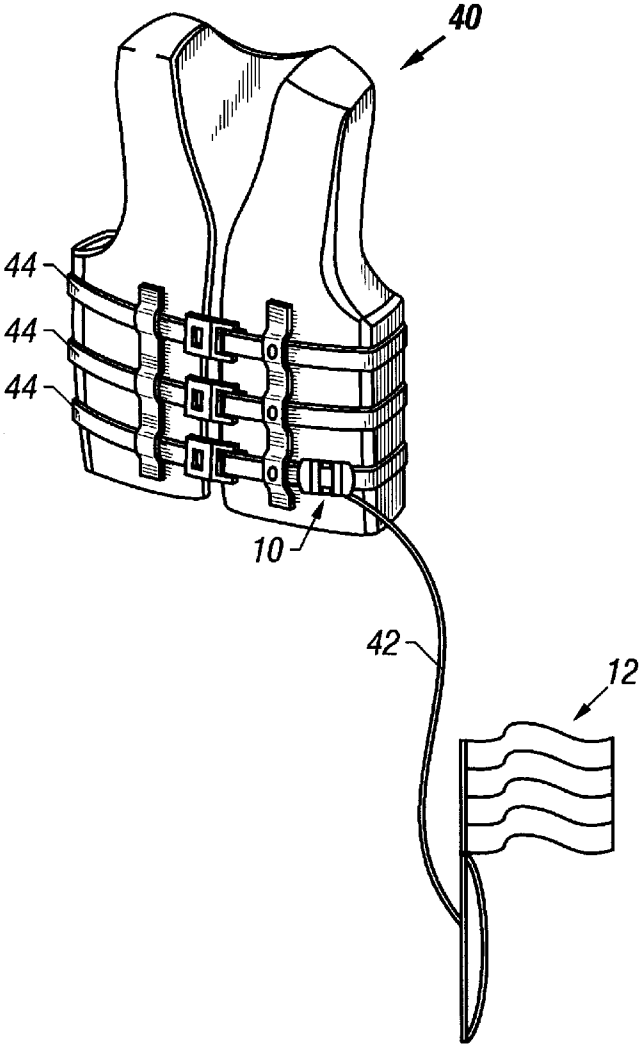
FIG. 4 is a front perspective view of a flotation vest and the expanded safety flag removed from its pouch.

FIG. 4 is a front perspective view of a flotation vest 40 and the expanded safety flag 12 removed from its pouch 10. The pouch 10 is fastened to the flotation vest. The pouch may be permanently or removably attached to the flotation vest. As illustrated in FIG. 4, the pouch may be attached to one of a plurality of adjustment straps 44 typically used on the flotation vest. One of the straps are thread through the loops 16 located on the back of the pouch, thereby removably fastening the pouch to the flotation vest. In other embodiments, the pouch may be permanently attached by sewing or glueing the pouch directly to the flotation vest. Any fastening means may be used to affix the pouch to the flotation vest, such as pins, adhesive strips, zippers, or hook and pile strips.

As illustrated in FIG. 4, the safety flag 12 is deployed from the pouch, expanding the flag to its full size. The safety flag may be attached to a cord 42 running directly from the pouch or the flotation vest 40. The cord may be any durable, flexible material preventing the inadvertent loss of the safety flag. Additionally, the cord may be constructed of a break-away material which breaks when applying a large amount of force. The cord may also be attached to the pouch or flotation device by hook and pile strips, allowing the quick release of the cord.

Although a flotation vest is depicted, any flotation device may be used in conjunction with the safety flag and pouch, such as a flotation cushion. Additionally, in the preferred embodiment of the present invention, the pouch is located on the front of the flotation vest, providing easy access to the wearer of the flotation vest. However, in alternate embodiments, the pouch may be located anywhere on the flotation device.

Referring to FIGS. 1–4, the operation of the safety flag 12 and its use on the flotation vest 40 will now be explained. When not in use, the safety flag is stowed within the pouch 10. The safety flag may be reduced in size by one of several different ways discussed above, such as a telescopic mast 30, detachable sections of the mast attached by bungee cord, or a flexible mast capable of being bent into a small area. The pouch must be large enough to accommodated the reduced size of the safety flag. By stowing the safety flag away, the safety flag is not obstructing the view or mobility of the user. In many existing safety flag systems, the flag is attached to the flotation vest without providing a means for retracting the flag away from view and also restricting the movement of the user.

The pouch is attached by a fastening means to the flotation vest 40. In one embodiment, the pouch is attached by inserting a strap located on the flotation vest through the loops 16 located at the rear of the pouch 10. By utilizing the loops, the pouch may be installed on an existing flotation vest without permanently affixing the pouch to the flotation vest. However, in alternate embodiments, the pouch may be directly attached to the flotation vest.

When the individual requires the use of the safety flag 12, such as when the individual falls into the water, the individual removes the safety flag from the pouch 10. The individual may use the optional handle 34 to allow an easy grasp of the safety flag. Additionally, in one embodiment, the flag is automatically expanded when the safety flag is removed from the pouch, such as when utilizing the flexible mast 30 bent in half. However, in another embodiment, the mast may be telescopically extended. In still another embodiment, detachable sections of the mast may be assembled to form a solid, rigid mast.

Once the flag is removed and expanded to its full position, the individual can wave the flag about himself, thereby attracting attention to himself. Additionally, the safety flag may be used by stranded individuals located on disabled water craft.

Figure 5:
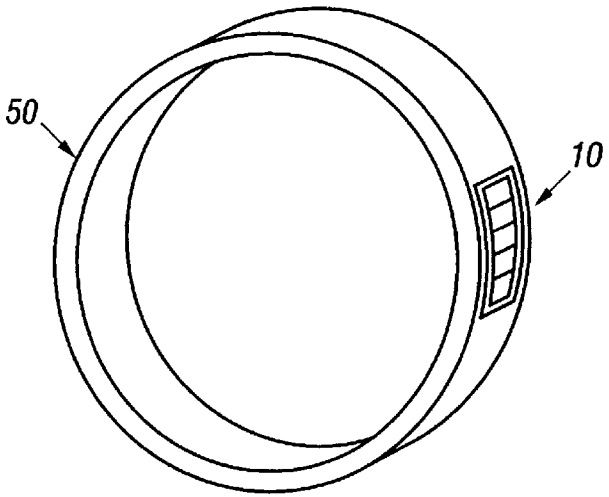
FIG. 5 is a front perspective view of the pouch affixed to an arm or leg band in an alternate embodiment of the present invention.

FIG. 5 is a front perspective view of the pouch 10 affixed to an arm or leg band 50 in an alternate embodiment of the present invention. The band is preferably constructed of an elastomeric material and is sized to fit on a limb, such as an arm or leg. The pouch and safety flag are reduced in size to fit on the band. An individual attaches the band to his wrist or ankle. The safety flag is stowed within the pouch as described above for the flotation vest 40. When needed, the safety flag is removed from the pouch and expanded to a larger size. The individual can then use the safety flag to signal water craft operators of the individual's location. In an alternate embodiment of the present invention, the band may affixed to the waste of the individual.

The safety flag and pouch described above provides many advantages over existing devices. The safety flag is removable from the flotation vest, thereby allowing an individual to wave the flag, which may more easily attract the attention of water craft operators. Existing signal flags are fixed to the flotation device, preventing the movement of the flag. Additionally, the safety flag is retained in a small area to prevent the restriction of movement and visibility of the individual wearing the pouch and safety flag. The flag may also be easily and quickly deployed during critical moments.

It is thus believed that the operation and construction of the present invention will be apparent from the foregoing description. While the apparatus shown and described has been characterized as being preferred, it will be readily apparent that various changes and modifications could be made therein without departing from the scope of the invention as defined in the following claims.

What is claimed is:

1. An expandable signaling system for use by a person, the system comprising:

a flotation vest providing flotation means to the person, the flotation vest having adjustment straps for conforming the flotation vest to the person;

a pouch attached to the flotation device, the pouch having an opening leading to an interior of the pouch, the pouch having a plurality of loops located on a back portion of the pouch, whereby one of the adjustment straps of the vest is laced through at least one of the loops of the pouch to attach the pouch to the flotation vest; and a safety flag having expanding means allowing the safety flag to be enlarged when deployed;

whereby the safety flag is stowed within the interior portion of the pouch and removed from the pouch and expanded to a larger size to allow the person to signal the location of the person.

2. The signaling system of claim 1 wherein the expanding means includes a telescopic mast extending the length of the safety flag.

3. The signaling system of claim 1 wherein the expanding means of the safety flag includes a flexible, elastomeric mast allowing the safety flag to be bent into a smaller area when stowed within the pouch, and automatically extended to the full length of the mast when removed from the pouch.

4. The signaling system of claim 1 wherein the expanding means includes a mast of the safety flag having detachable sections attached to a flexible cord, whereby the mast is assembled to a full length by connecting the sections together.

5. An expandable signaling system for use by a person, the system comprising:

a flotation device providing flotation means to the person;

a pouch attached to the flotation device, the pouch having an opening leading to an interior of the pouch;

a safety flag having expanding means allowing the safety flag to be enlarged when deployed; and a retaining cord connecting the safety flag to the pouch;

whereby the safety flag is stowed within the interior portion of the pouch and removed from the pouch and expanded to a larger size to allow the person to signal the location of the person.

6. The signaling device of claim 5 wherein the expanding means of the safety flag includes a flexible mast allowing the safety flag to be bent into a smaller area when stowed within the pouch, and automatically extended to the full length of the mast when removed from the pouch.

7. The signaling system of claim 5 wherein the expanding means includes a mast of the safety flag having detachable sections attached to a flexible cord, whereby the mast is assembled to a full length by connecting the sections together.

8. An expandable signaling system for use by a person, the system comprising:

a band attached to the person;

a pouch attached to the band, the pouch having an opening leading to an interior of the pouch; and a safety flag having expanding means allowing the safety flag to be enlarged when deployed;

whereby the safety flag is stowed within the interior of the pouch and removed from the pouch and expanded to a larger size to allow the person to signal the location of the person.

9. The system of claim 8 further comprising a retaining cord connecting the safety flag to the pouch.

* * * * *